US006118466A

United States Patent [19]

Lee

[11] Patent Number: 6,118,466

[45] Date of Patent: Sep. 12, 2000

[54] METHOD AND APPARATUS FOR CONTROLLING CONCENTRATION OF DEVELOPER IN DEVELOPING RESERVOIR OF WET PRINTER

[75] Inventor: Beom-ro Lee, Seoul, Rep. of Korea

[73] Assignee: Samsung Electronics Co., Ltd., Kyungki-do, Rep. of Korea

[21] Appl. No.: 09/095,649

[22] Filed: Jun. 11, 1998

[30] Foreign Application Priority Data

Aug. 1, 1997 [KR] Rep. of Korea ..... 97-36881

[51] Int. Cl.[7] ..... B41J 2/385; G03G 9/08; G03G 15/00; G03G 15/10

[52] U.S. Cl. ..... 347/158; 347/140; 399/27; 399/43; 399/57; 399/58; 399/233; 399/237

[58] Field of Search ..... 347/115, 140, 347/158; 399/27, 43, 58, 57, 60, 233, 237, 258

[56] References Cited

U.S. PATENT DOCUMENTS 5,227,847 7/1993 Motohashi et al. ..... 399/27
5,724,627 3/1998 Okuno et al. ..... 399/27
5,797,061 8/1998 Overall et al. ..... 399/27
5,802,420 9/1998 Garr et al. ..... 399/27
5,923,356 7/1999 Gibson et al. ..... 399/58 X
5,974,229 10/1999 Yoshino ..... 399/58 X

*Primary Examiner*—Susan S. Y. Lee
*Attorney, Agent, or Firm*—Sughrue, Mion, Zinn, Macpeak & Seas, PLLC

[57] ABSTRACT

A method for controlling concentration of a developer in a developing reservoir of a wet printer includes the steps of counting image data output from a system controller to a laser scanning unit to form an electrostatic latent image on a photosensitive medium, calculating the amount of a consumed toner supplied from the developing reservoir to the photosensitive belt according to a value counted in the counting step of formation of the electrostatic latent image, and supplying toner from a toner supplying unit into the developing reservoir to refill the amount of the consumed toner calculated in the calculation step. The developer also includes a liquid carrier element. Thus, the ratio of the toner to liquid carrier element in the developing reservoir may be maintained within a predetermined range, without having an additional apparatus for measuring the concentration of the developer.

3 Claims, 3 Drawing Sheets

METHOD AND APPARATUS FOR CONTROLLING CONCENTRATION OF DEVELOPER IN DEVELOPING RESERVOIR OF WET PRINTER

BACKGROUND OF THE INVENTION

1. Field of the Invention

The present invention relates to a method for controlling the concentration of a developer in a developing reservoir of a wet printer and an apparatus therefor. More particularly, this invention is directed to a method for controlling the concentration of a developer in a developing reservoir of a wet printer to maintain the concentration of the developer, in which a toner mixes with a liquid carrier element, within a predetermined range, and to an apparatus for supplying the developer of the wet printer.

2. Description of the Related Art

Referring to FIG. 1 showing a typical wet printer, a resetting apparatus 15, laser scanning units 16, developing units 30, a drying unit 18 and a transferring unit 20 are arranged and spaced apart from each other by a predetermined distance, adjacent to a circulation path of a photosensitive belt 14 circulated by three rollers 11, 12 and 13.

In the process of printing, the laser scanning units 16 scan light beams over a predetermined region of the photosensitive belt 14, which is circulated via the resetting apparatus 15. An electrostatic latent image is formed on the photosensitive belt 14 by the scanned light, and the electrostatic latent image is developed by a developer supplied from each developing unit 30. A color image is formed on the photosensitive belt 14 by the laser scanning units 16 which scan light beams of various colors and the developing units 30 which develop the scanned image with the developer corresponding to the color information of the light beam. Most of the liquid carrier element which is supplied to the photosensitive belt 14 from the developing unit 30, but not used, is returned into the developing unit 30.

The photosensitive belt 14 moves through the drying unit 18, which rotates partially in contact with the photosensitive belt 14. The drying unit 18 removes the liquid carrier element remaining on the photosensitive belt 14. The color image formed on the photosensitive belt 14 by a toner is then primarily transferred to a transfer roller 21, according to continuous movement of the photosensitive belt 14. Then, the image formed on the transfer roller 21 is secondarily transferred onto a sheet of paper 23 proceeding forward according to rotation of the transfer roller 21 and a pressure roller 22 which contact each other.

The developing process will be described with reference to FIG. 2 in more detail. The developing unit 30 includes a spray 33 for spraying a developer 32 stored in a developing reservoir 31, two squeeze rollers 34 and 35 for separating a liquid carrier element 32*a* which has not been used to form an image, and plates 36 and 37 for collecting the carrier element 32*a* flowing from the squeeze rollers 34 and 35 back into the developing reservoir 31. Reference numeral 38 indicates back-up rollers.

In the developing process, a toner 32*b*, of the developer 32 supplied onto the photosensitive belt 14 by the spray 33, attaches onto the electrostatic latent image of the photosensitive belt 14 by electrical attraction. Meanwhile, the liquid carrier element 32*a* of the developer 32 supplied onto the photosensitive belt 14 is mostly collected into the developing reservoir 31 as it passes through the two squeeze rollers 34 and 35.

Since the toner 32*b* is consumed during the above developing process, while the liquid carrier element 32*a* is not, the concentration of the developer 32 with respect to the toner 32*b* in the developing reservoir 31 is diluted. Thus, in order to appropriately maintain developing conditions, so that the concentration of the toner is maintained within a predetermined range, the toner 32*b* must be periodically supplied into the developing reservoir 31 to replenish the amount of the consumed toner. In the conventional art, a concentration measuring apparatus for controlling the concentration of the developer 32 in the developing reservoir 31 is installed in the printer, so that the structure of the printer is more complicated.

SUMMARY OF THE INVENTION

To solve the above problem, it is an objective of the present invention to provide a method and apparatus for controlling the concentration of a developer in a developing reservoir of a wet printer, by calculating the consumed amount of a toner based on information related to image printing, in order to control the concentration of the developer without requiring a concentration measuring apparatus.

Accordingly, to achieve the above objective, a method for controlling the concentration of a developer in a developing reservoir of a wet printer according to the present invention includes the steps of: counting image data output from a system controller to a laser scanning unit to form an electrostatic latent image on a photosensitive medium; calculating the amount of a consumed toner supplied from the developing reservoir to the photosensitive belt according to a value counted in the counting step to form the electrostatic latent image; and supplying the toner of a toner supplying unit into the developing reservoir to refill the amount of the consumed toner calculated in the calculation step.

Preferably, the method further comprises the step of counting the number of paper sheets printed by a toner image corresponding to the electrostatic latent image to estimate the loss amount of the liquid carrier element, and supplying the amount of the liquid carrier element calculated by a liquid carrier element supplying unit to the developing reservoir.

Also, to achieve the above objective, an apparatus for controlling the concentration of a developer of a wet printer includes: a toner supplying unit for supplying a toner into a developing reservoir of a developing unit supplying the developer onto a photosensitive medium of a region where an electrostatic latent image is formed in which the toner is mixed with a liquid carrier element by a predetermined ratio, in order to develop the electrostatic latent image formed on the photosensitive medium; a liquid carrier element supplying unit for supplying the liquid carrier element into the developing reservoir; and a supply controller for counting image data output from a system controller of a printer output to a laser scanning unit to form the electrostatic latent image and thus calculating the amount of a consumed toner, and controlling supply of the toner of the toner supplying unit such that the toner is supplied from the toner supplying unit to the developing reservoir to refill the amount of the consumed toner.

Preferably, the apparatus further comprises a paper counter for counting the number of paper sheets printed by a toner image corresponding to the electrostatic latent image, wherein the supply controller calculates the loss amount of the liquid carrier element from the number of the counted paper sheets, and controls the liquid carrier element supplying unit such that the liquid carrier element is supplied from the liquid carrier element supplying unit into the developing reservoir to refill the amount of the lost liquid carrier element.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENTS

Figure 1:
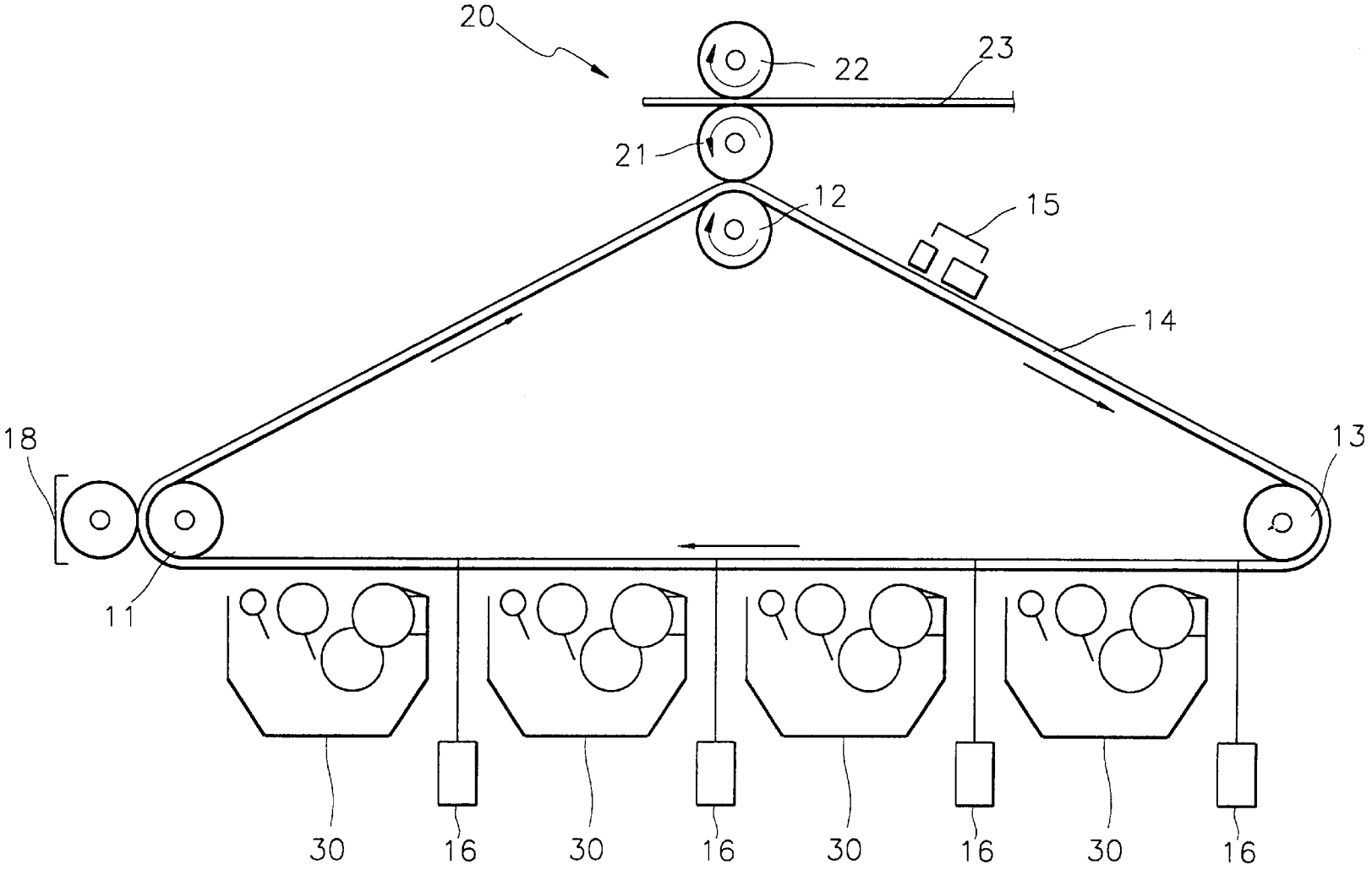
FIG. 1 shows the structure of a typical wet printer.
Figure 2:
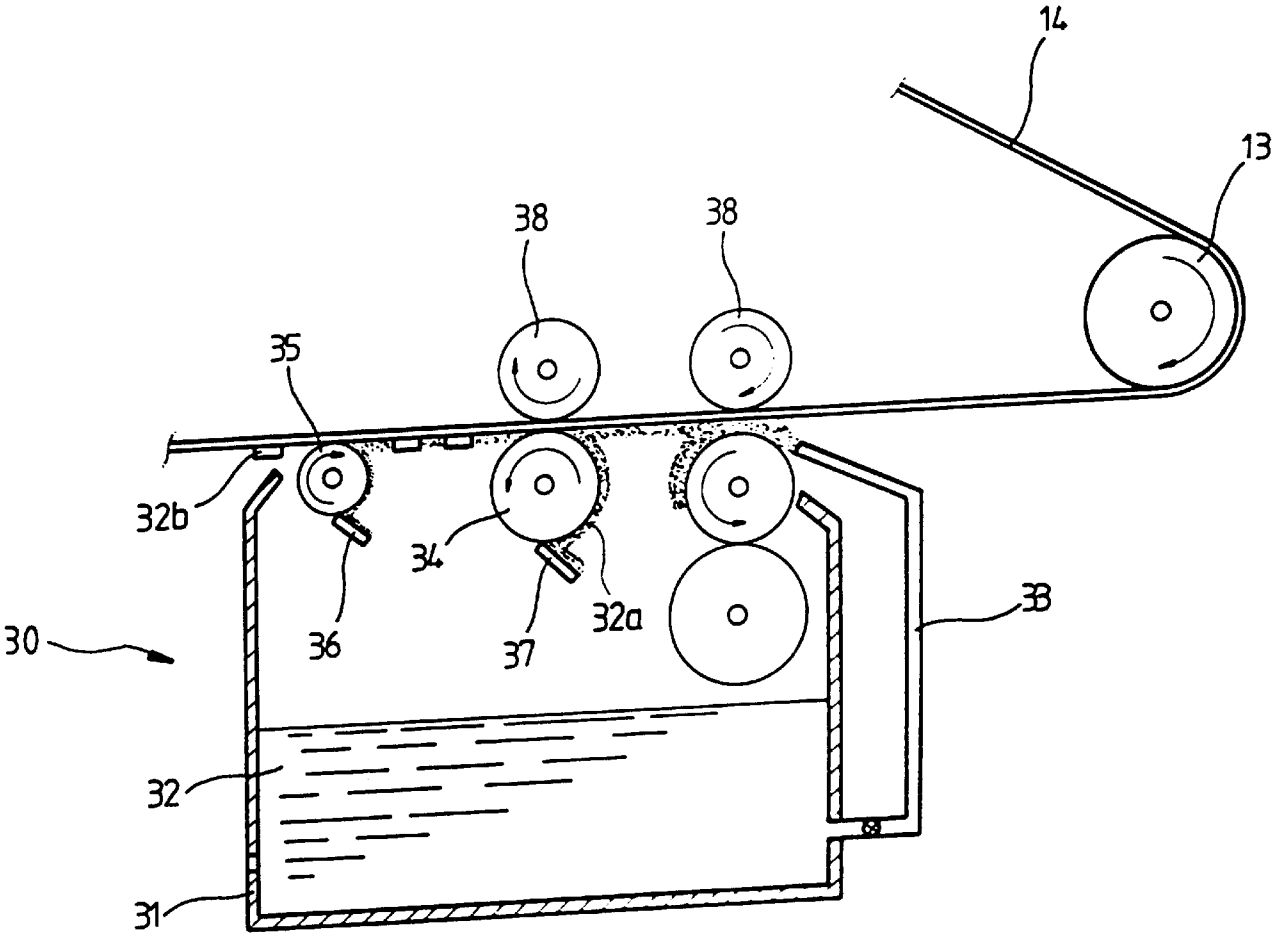
FIG. 2 PRIOR ART
FIG. 2 is an enlarged diagram of the developing unit of FIG. 1.
Figure 3:
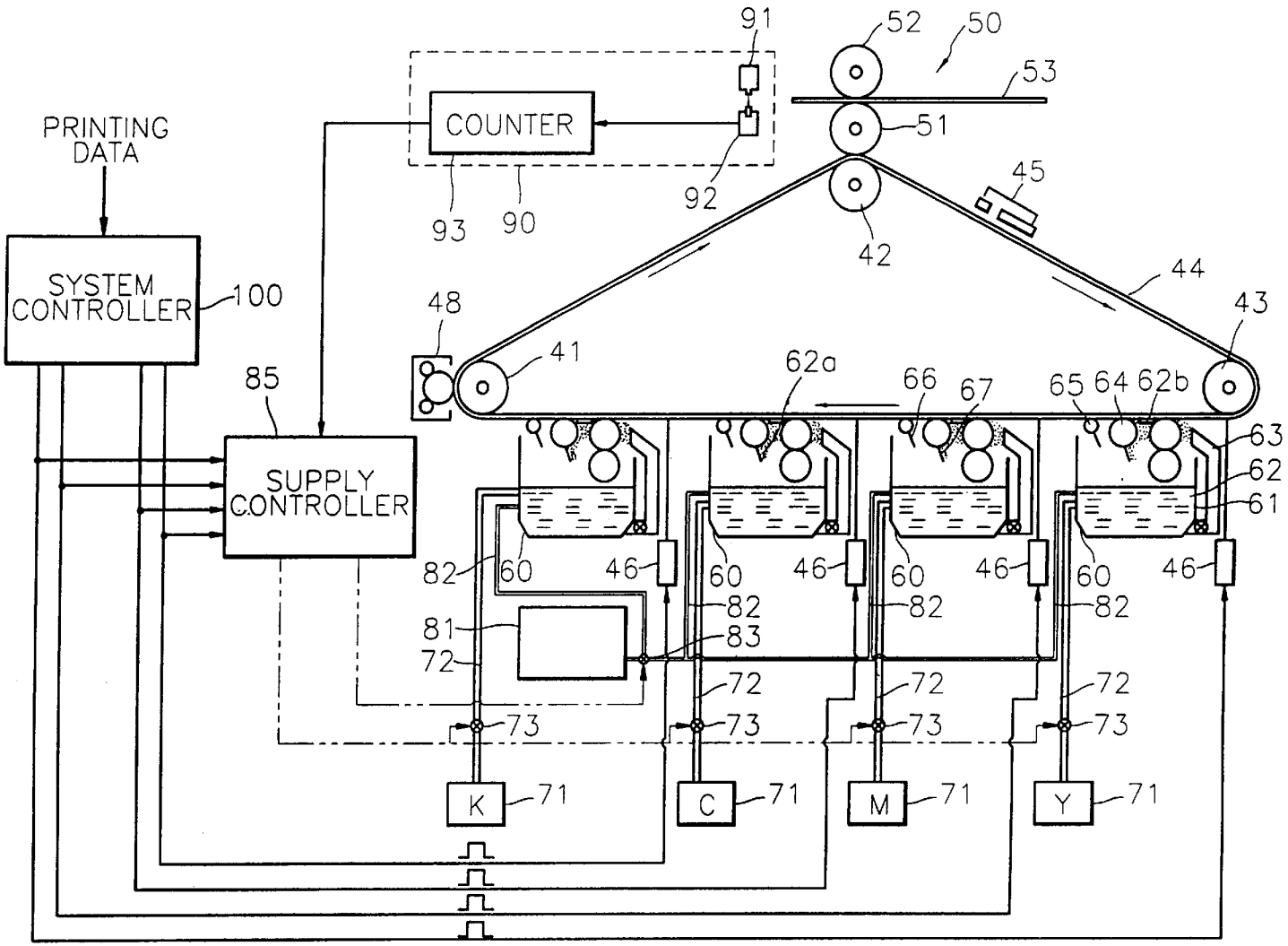
FIG. 3 is a developer concentration controlling apparatus of a wet printer according to the present invention.

Referring to FIG. 3, a resetting unit 45, laser scanning units 46, developing units 60, a drying unit 48 and a transferring unit 50 are arranged adjacent to a circulation path of a photosensitive belt 44 moved by three rollers 41, 42 and 43 which are spaced apart from each other by a predetermined distance. A developer concentration controlling apparatus includes a toner supplying unit, a liquid carrier element supplying unit, a paper counter 90 and a supply controller 85.

Each of the developing units 60 includes a spray 63 for spraying the developer 62 stored in a developing reservoir 61 onto the photosensitive belt 44, two squeeze rollers 64 and 65 for separating the liquid carrier element 62*a* which is not used to form an image from the developer 62 sprayed onto the photosensitive belt 44, and two plates 66 and 67 for collecting the carrier element 62*a* flowing down the squeeze rollers 64 and 65 back into the developing reservoir 61.

The toner supplying unit includes four toner suppliers 71 having toners 62*b* of yellow (Y), magenta (M), cyan (C) and black (K), outlet tubes 72 connecting the four toner suppliers 71 to the developing reservoirs 61, respectively, and toner supply pumps 73 provided on the outlet tubes 72 and driven under control of the supply controller 85, respectively.

The liquid carrier element supplying unit includes a carrier element supplier 81, outlet tubes 82 connecting the carrier element supplier 81 to the developing reservoirs 61 of each color, and carrier element supply pumps 83 driven under control of the supply controller 85. The liquid carrier element supplying unit may be designed so that the carrier element 62*a* collected by evaporation in the drying unit 48 is supplied back to the carrier element supplier 81.

The paper counter 90 includes a photo interrupter having a light source 91 and a photo detector 92 for identifying a printed paper sheet 53 passing between a transfer roller 51 and a pressing roller 52 in order to output a signal corresponding to the identified paper 53, and a counter 93 counting a pulse signal of the photo detector 92. Alternatively, a contact switch (not shown) interrupted by the printed paper instead of the photo interrupter may be installed.

The supply controller 85 receives a modulation signal, which is output as image data to the light scanning units 46, from a system controller 100 to control supply of the toner of the toner supplier 71 into the developing reservoir 61, and receives a counted signal of the paper counter 90, to control supply of the carrier element 62*a* of the liquid carrier element supplier 81 into the developing reservoir 61. The modulation signal is expressed as a binary signal corresponding to existence and non-existence of light emission for presence and absence of the image per pixel.

In the process of printing, the system controller 100 reads input printing data, and outputs the modulation signal, per color, to each light scanning unit 46 to form an electrostatic latent image on the photosensitive belt 44 corresponding to the printing data.

For instance, if the modulation signal output in a predetermined period has a high level, light beams are emitted, and if it has a low level, the light scanning unit 46 operates to suppress the emission of light. In the following case, an electrostatic latent image corresponding to an output pattern of the modulation signal having a high level is formed on the photosensitive belt 44. The developer 62 is supplied to a region of the electrostatic latent image by operation of the spray 63 of the developing unit 60, and the toner 62*b* of the developer 62 attaches to the region of the electrostatic latent image of the photosensitive belt 44 by electric attraction. The liquid carrier element 62*a* of the developer that is supplied onto the photosensitive belt 44 is collected back into the developing reservoir 61 by the squeeze rollers 64 and 65. As a result, if the modulation signal of the system controller 100 output to the laser scanning unit 46 at a predetermined period has a high level, the toner 62*b* of a predetermined amount is consumed.

According to a method for controlling concentration of a developer in a developing reservoir 61 of the present invention, the modulation signals are output from the system controller 100 to laser scanning unit 46, an interval of generating a high level signal corresponding to the toner supply is counted at a predetermined period of a pixel unit, and the amount of the consumed toner is calculated from the counted value. The supply controller 85 drives the pump 73 so that the toner 62*b* of the toner supplier 71 is supplied to the developing reservoir 61 when the counted amount of the consumed toner 62*b* reaches a target value, or at a predetermined period.

Meanwhile, if all of the liquid carrier element 62*a* is collected back, an additional supply of the liquid carrier element 62*a* into the developing reservoir 61 is not required, however, a loss due to natural evaporation must be addressed. According to the present invention, the loss amount of the liquid carrier element 62*a* is estimated by the number of printed papers 53. Thus, the operation of the carrier element supply is controlled by the supply controller 85 such that the liquid carrier element 62*a* is supplied from the carrier element supplier 81 to the developing reservoir 61 to refill the lost carrier element.

In a developer concentration controlling apparatus of a printer employing the above concentration controlling method, the supply controller 85 controls driving of the toner supply pump 73 such that the toner 62*b* of a color corresponding to a counter (not shown) which reaches a target value, among counters (not shown) installed inside for each color in order to count the modulation signals output to the laser scanning unit 46, is supplied into the developing reservoir 61 of a corresponding color. If an output signal of the paper counter 90 for counting the number of paper sheets printed through the transferring unit 50 reaches a predetermined value, the driving of the pump 83 for supplying the carrier element 62*a* is controlled such that the liquid carrier element 62*a* having the amount corresponding to the value is supplied into the developing reservoir 61.

As described above, according to the method and apparatus for controlling the concentration of a developer in a developing reservoir of a wet printer, the mixing ratio of a toner with a liquid carrier element in the developing reservoir may be maintained within a predetermined range, without requiring an additional apparatus for measuring the concentration of the developer.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A method for controlling concentration of a developer in a developing reservoir of a wet printer comprising the steps of:

(a) counting image data output from a system controller to a laser scanning unit to form an electrostatic latent image on a photosensitive medium;

(b) calculating an amount of a consumed toner supplied from the developing reservoir to the photosensitive medium during formation of a toner image, the calculated amount being based on a value counted in step (a) to form the electrostatic latent image;

(c) supplying toner from a toner supplying unit into the developing reservoir to refill the amount of the consumed toner calculated in step (b); and (d) counting a number of paper sheets printed by a toner image corresponding to the electrostatic latent image, to calculate an amount of a consumed liquid carrier element which is supplied from the developing reservoir to the photosensitive medium to form the toner image, and supplying the calculated amount of the consumed liquid carrier element from a liquid carrier element supplying unit to the developing reservoir.

2. The method of claim 1, wherein the image data is a modulation signal for emitting light beams of the laser scanning unit.

3. An apparatus for controlling concentration of a developer of a wet printer comprising:

a toner supplying unit for supplying a toner into a developing reservoir of a developing unit, the developing unit supplying the developer stored in the developing reservoir onto a region of a photosensitive medium where an electrostatic latent image is formed in order to develop the electrostatic latent image on the photosensitive medium, the toner being mixed with a liquid carrier element by a predetermined ratio in the developing reservoir;

a liquid carrier element supplying unit for supplying the liquid carrier element into the developing reservoir;

a supply controller for counting image data output from a system controller of a printer to a laser scanning unit to form the electrostatic latent image and for calculating an amount of toner which is consumed based on a value calculated by counting the image data, and for controlling supply of the toner of the toner supplying unit to the developing reservoir so as to refill the amount of the consumed toner; and a paper counter for counting a number of paper sheets printed by a toner image corresponding to the electrostatic latent image, wherein the supply controller calculates an amount of consumed liquid carrier element based on the number of the counted paper sheets, and controls the liquid carrier element supplying unit so that the liquid carrier element is supplied from the liquid carrier element supplying unit into the developing reservoir to refill the amount of the consumed liquid carrier element.

* * * * *